US008929789B2

(12) United States Patent
Yoshinaga et al.

(10) Patent No.: US 8,929,789 B2
(45) Date of Patent: Jan. 6, 2015

(54) FIXING DEVICE WITH RESISTANCE HEATING ELEMENT CAPABLE OF ACCURATELY GENERATING HEAT AND IMAGE FORMING APPARATUS WITH FIXING DEVICE

(75) Inventors: Hiroshi Yoshinaga, Chiba (JP); Masaaki Yoshikawa, Tokyo (JP); Kenji Ishii, Kanagawa (JP); Yuji Arai, Kanagawa (JP); Hiromasa Takagi, Tokyo (JP); Naoki Iwaya, Tokyo (JP); Tetsuo Tokuda, Kanagawa (JP); Ippei Fujimoto, Kanagawa (JP); Yoshiki Yamaguchi, Kanagawa (JP); Yutaka Ikebuchi, Kanagawa (JP); Takuya Seshita, Kanagawa (JP); Arinobu Yoshiura, Kanagawa (JP); Takahiro Imada, Kanagawa (JP); Hajime Gotoh, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 186 days.

(21) Appl. No.: 13/413,034

(22) Filed: Mar. 6, 2012

(65) Prior Publication Data

US 2012/0237273 A1 Sep. 20, 2012

(30) Foreign Application Priority Data

Mar. 17, 2011 (JP) ..... 2011-059596

(51) Int. Cl.
*G03G 15/20* (2006.01)

(52) U.S. Cl.
CPC ..... *G03G 15/2039* (2013.01); *G03G 15/2053* (2013.01); *G03G 2215/2035* (2013.01)
USPC ..... 399/329; 399/67; 399/122; 399/328

(58) Field of Classification Search
USPC ..... 399/328, 329
See application file for complete search history.

(56) References Cited

U.S. PATENT DOCUMENTS

| | | | |
|---|---|---|---|
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |
| 6,785,505 | B2 | 8/2004 | Yasui et al. |
| 6,813,464 | B2 | 11/2004 | Amita et al. |
| 6,881,927 | B2 | 4/2005 | Yoshinaga et al. |
| 6,882,820 | B2 | 4/2005 | Shinshi et al. |

(Continued)

FOREIGN PATENT DOCUMENTS

| | | | |
|---|---|---|---|
| JP | 04044075 | A | 2/1992 |
| JP | 10213984 | A | 8/1998 |

(Continued)

*Primary Examiner* — Francis Gray
(74) *Attorney, Agent, or Firm* — Harness, Dickey & Pierce, P.L.C.

(57) ABSTRACT

In a fixing device, a heating element is extended along a fixing member at a location other than a nip on an inner circumferential surface side of the fixing member to generate heat. The fixing member contacts the heating element either indirectly via a gap of a prescribed size or directly contacts the heating element by with a prescribed pressure when the fixing member is rotating, and continuously separates from the heating element by a prescribed distance greater than the size of the gap when the fixing member stops rotating.

15 Claims, 7 Drawing Sheets

(56) References Cited

U.S. PATENT DOCUMENTS 6,892,044 B2 5/2005 Yasui et al.
6,937,827 B2 8/2005 Katoh et al.
7,022,944 B2 4/2006 Yoshinaga et al.
7,054,570 B2 5/2006 Kishi et al.
7,116,923 B2 10/2006 Kishi et al.
7,127,204 B2 10/2006 Satoh et al.
7,130,555 B2 10/2006 Kishi et al.
7,151,907 B2 12/2006 Yoshinaga
7,209,675 B2 4/2007 Matsusaka et al.
7,212,758 B2 5/2007 Kishi et a
7,212,759 B2 5/2007 Kishi et al.
7,239,821 B2 7/2007 Matsusaka et al.
7,239,838 B2 7/2007 Sato et al.
7,242,897 B2 7/2007 Satoh et al.
7,308,216 B2 12/2007 Kishi et al.
7,313,353 B2 12/2007 Satoh et al.
7,333,743 B2 2/2008 Kishi et al.
7,343,113 B2 3/2008 Matsusaka et al.
7,352,987 B2 4/2008 Iwata et al.
7,356,270 B2 4/2008 Matsusaka et al.
7,366,432 B2 4/2008 Kishi et al.
7,373,094 B2 5/2008 Kishi et al.
7,379,698 B2 5/2008 Yoshinaga
7,437,111 B2 10/2008 Yamada et al.
7,454,151 B2 11/2008 Satoh et al.
7,466,949 B2 12/2008 Satoh et al.
7,496,309 B2 2/2009 Matsusaka et al.
7,509,085 B2 3/2009 Yoshinaga et al.
7,515,845 B2 4/2009 Kishi et al.
7,546,049 B2 6/2009 Ehara et al.
7,551,869 B2 6/2009 Kishi et al.
7,565,087 B2 7/2009 Matsusaka et al.
7,570,910 B2 8/2009 Ishii
7,603,049 B2 10/2009 Kishi et al.
7,609,988 B2 10/2009 Kishi et al.
7,664,410 B2 2/2010 Takagi
7,702,271 B2 4/2010 Yamada et al.
7,783,240 B2 8/2010 Ito et al.
7,796,933 B2 9/2010 Ueno et al.
7,801,457 B2 9/2010 Seo et al.
7,840,151 B2 11/2010 Fujimoto
7,885,569 B2 2/2011 Kishi et al.
7,912,392 B2 3/2011 Yoshinaga et al.
7,925,177 B2 4/2011 Ishii et al.
7,953,338 B2 5/2011 Takagi
7,957,663 B2 6/2011 Kishi et al.
7,983,598 B2 7/2011 Shinshi et al.
8,023,861 B2 9/2011 Yoshinaga et al.
8,064,798 B2 11/2011 Shinshi et al.
8,073,352 B2 12/2011 Kunii et al.
8,131,198 B2 3/2012 Ishii et al.
2002/0018663 A1 2/2002 Furukawa et al.
2002/0067936 A1 6/2002 Yasui et al.
2003/0000933 A1 1/2003 Yoshinaga et al.
2003/0007813 A1 1/2003 Yasui et al.
2003/0016963 A1 1/2003 Yoshinaga et al.
2003/0165348 A1 9/2003 Amita et al.
2003/0206758 A1 11/2003 Yasui et al.
2003/0215271 A1 11/2003 Yoshinaga et al.
2004/0013453 A1 1/2004 Shinshi et al.
2004/0245241 A1 12/2004 Kishi et al.
2004/0247332 A1 12/2004 Kishi et al.
2004/0247334 A1 12/2004 Kishi et al.
2004/0258426 A1 12/2004 Kishi et al.
2005/0025539 A1 2/2005 Yoshinaga
2005/0074251 A1 4/2005 Katoh et al.
2005/0095043 A1 5/2005 Yoshinaga et al.
2005/0123315 A1 6/2005 Kishi et al.
2005/0139584 A1 6/2005 Kishi et al.
2005/0163543 A1 7/2005 Satoh et al.
2005/0175368 A1 8/2005 Matsusaka et al.
2005/0175370 A1 8/2005 Matsusaka et al.
2005/0180786 A1 8/2005 Yamada et al.
2005/0191078 A1 9/2005 Kishi et al.
2006/0029411 A1 2/2006 Ishii et al.
2006/0039713 A1 2/2006 Kishi et al.
2006/0051111 A1 3/2006 Kishi et al.
2006/0051112 A1 3/2006 Matsusaka et al.
2006/0051113 A1 3/2006 Kishi et al.
2006/0051119 A1 3/2006 Kishi et al.
2006/0051120 A1 3/2006 Kishi et al.
2006/0051121 A1 3/2006 Matsusaka et al.
2006/0116230 A1 6/2006 Satoh et al.
2006/0127118 A1 6/2006 Kishi et al.
2006/0165429 A1 7/2006 Satoh et al.
2006/0165443 A1 7/2006 Yoshinaga et al.
2006/0165448 A1 7/2006 Yoshinaga
2006/0182460 A1 8/2006 Kishi et al.
2006/0257183 A1 11/2006 Ehara et al.
2006/0285893 A1 12/2006 Ishii
2007/0014600 A1 1/2007 Ishii et al.
2007/0014603 A1 1/2007 Satoh et al.
2007/0025754 A1 2/2007 Takagi
2007/0071521 A1* 3/2007 Jeong ..... 399/329
2007/0212090 A1 9/2007 Matsusaka et al.
2008/0063443 A1 3/2008 Yoshinaga et al.
2008/0145088 A1 6/2008 Matsusaka et al.
2008/0219721 A1 9/2008 Ito et al.
2008/0226326 A1 9/2008 Seo et al.
2008/0232873 A1 9/2008 Ueno et al.
2008/0253789 A1 10/2008 Yoshinaga et al.
2008/0317532 A1 12/2008 Ehara et al.
2009/0003867 A1 1/2009 Fujimoto
2009/0010687 A1 1/2009 Yamada et al.
2009/0067902 A1 3/2009 Yoshinaga et al.
2009/0123172 A1 5/2009 Kishi et al.
2009/0123201 A1 5/2009 Ehara et al.
2009/0123202 A1 5/2009 Yoshinaga et al.
2009/0148204 A1 6/2009 Yoshinaga et al.
2009/0162115 A1* 6/2009 Kobayashi ..... 399/329
2009/0169232 A1 7/2009 Kunii et al.
2009/0245865 A1 10/2009 Shinshi et al.
2009/0317113 A1 12/2009 Kishi et al.
2010/0074667 A1 3/2010 Ehara et al.
2010/0086335 A1* 4/2010 Sugaya ..... 399/329
2010/0092220 A1 4/2010 Hasegawa et al.
2010/0092221 A1 4/2010 Shinshi et al.
2010/0202809 A1 8/2010 Shinshi et al.
2010/0290822 A1 11/2010 Hasegawa et al.
2010/0303521 A1 12/2010 Ogawa et al.
2011/0026988 A1* 2/2011 Yoshikawa et al. ..... 399/329
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064451 A1 3/2011 Yamaguchi et al.
2011/0064490 A1 3/2011 Imada et al.
2011/0064502 A1 3/2011 Hase et al.
2011/0076071 A1 3/2011 Yamaguchi et al.
2011/0085815 A1 4/2011 Kishi et al.
2011/0085832 A1 4/2011 Hasegawa et al.
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176822 A1 7/2011 Ishii et al.
2011/0182634 A1* 7/2011 Ishigaya et al. ..... 399/328
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.

(56) References Cited

U.S. PATENT DOCUMENTS

| | | | | |
|---|---|---|---|---|
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217094 | A1 * | 9/2011 | Hasegawa | 399/329 |
| 2011/0217095 | A1 | 9/2011 | Ishii et al. | |
| 2011/0222875 | A1 | 9/2011 | Imada et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0274453 | A1 | 11/2011 | Shimokawa et al. | |
| 2011/0286758 | A1 | 11/2011 | Yoshinaga | |
| 2012/0051774 | A1 | 3/2012 | Ikebuchi et al. | |
| 2012/0114345 | A1 | 5/2012 | Fujimoto et al. | |
| 2012/0121304 | A1 | 5/2012 | Tokuda et al. | |
| 2012/0121305 | A1 | 5/2012 | Yoshikawa et al. | |

FOREIGN PATENT DOCUMENTS

| | | | |
|---|---|---|---|
| JP | 11002982 | A | 1/1999 |
| JP | 2007334205 | A | 12/2007 |
| JP | 2008158482 | A | 7/2008 |
| JP | 2008-216928 | A | 9/2008 |
| JP | 2009003410 | A | 1/2009 |
| JP | 2011232555 | A * | 11/2011 |

* cited by examiner

FIXING DEVICE WITH RESISTANCE HEATING ELEMENT CAPABLE OF ACCURATELY GENERATING HEAT AND IMAGE FORMING APPARATUS WITH FIXING DEVICE

CROSS-REFERENCE TO RELATED APPLICATION

This patent application is based on and claims priority pursuant to 35 U.S.C. §119 to Japanese Patent Application No. 2011-059596, filed on Mar. 17, 2011 in the Japanese Patent Office, the entire disclosure of which is hereby incorporated by reference herein.

BACKGROUND OF THE INVENTION

1. Field of the Invention

The present invention relates to a fixing device and an image forming apparatus, in particular to a fixing device and an image forming apparatus employing a belt type fixing system using a belt as a fixing member, which is capable of accurately generating heat.

2. Description of the Related Art

As is well known, in an image forming apparatus employing an electro-photographic system, an electrostatic latent image is formed on a photoconductor as a latent image bearer and is rendered visible with toner to form a toner image. Subsequently, the toner image is transferred onto a recording medium, such as a recording sheet, etc., and is fixed thereon. The recording sheet is then outputted as a copy.

As a fixing system, a heat roller type is known in which a fixing roller and a pressing roller are arranged parallel and opposed to each other to sandwich a sheet therebetween and fix a toner image onto the sheet with heat provided from a heat source installed in the fixing roller and pressure applied from the pressing roller.

Also known is a belt-type fixing system, in which a fixing belt constructed of a good thermal conductor is employed as an alternative to the fixing roller. The belt-type system further includes a pressing roller, multiple rollers around which the belt is wound, and a heat source for heating the belt. An advantage of the belt-type fixing system is that a warm-up time needed to increase the temperature of the belt to a predetermined fixing temperature level can be shortened over that needed in the heat roller fixing system.

As an example of a fixing device employing such a fixing belt system, Japanese Patent Application Publication No. 11-002982 (JP-H11-002982-A) discloses a fixing system that includes a heating roller having a heater as a heat source, a fixing belt (i.e., a fixing member) that accommodates a fixing roller having a rubber surface within its loop, and a pressing roller (i.e., a pressing member) contacting the fixing belt outside the loop. In such a fixing system, when a recording sheet reaches the fixing device with a transferred toner image thereon and enters and passes through a nip formed between the pressing roller and the fixing roller (i.e., passes between the pressing roller and the fixing roller as conveyed by the fixing belt, the toner image is heated and pressed, and is accordingly fused in place on the recording sheet.

As an alternative to the above-described system, a film-type heating system is described in Japanese Patent Application Publication No. 04-44075 (JP-H04-44075-A), in which a fixed member sliding on an inner surface of a rotating member is employed, for example. Such a fixed member sliding on an inner surface of a rotating member is also employed in a pressing-type belt system as described in Japanese Patent Application Publication No. 10-213984 (JP-H10-213984-A).

However, a problem with the above-described fixing systems is that they require a long time to warm up due to bad durability, poor temperature stability, and large heat capacity, as well as slow temperature rising of the belt.

To solve the above-described problems, for example, Japanese Patent Application Publication No. 2007-334205 (JP-2007-334205-A) proposes a system in which a an endless belt is wound around a pipe state heat conductor made of metal (i.e., a metal pipe) to disperse heat uniformly over the entire inner surface of the endless belt, thereby stabilizing the temperature of the endless belt. As a development of the system of JP-2007-334205-A, for example, Japanese Patent Application Publication No. 2008-158482 (JP-2008-158482-A) proposes a technology utilizing a resistance heating element as a heat source for the endless belt.

In these systems, the endless belt moves or circulates in conjunction with rotation of the pressing roller opposed thereto and consecutively provides different belt portions thereof to a fixing position for fixing a toner image on a recording sheet to supply heat thereto.

Further, for example, Japanese Patent Application Publication No. 2008-216928 (JP-2008-216928-A) proposes a system that provides a small gap δ between the above-described resistance heating element and an inner surface of the endless belt (e.g., $0<\delta\leq 1$ mm, wherein δ represents the gap) to avoid contact between the heating element and the belt, so that the belt can circulate at high speed to facilitate uniform heating of the entire belt.

However, it turns out that a resistance heating element is such that its calorific value changes with temperature even at constant voltage, because the heating element's internal resistance changes. Consequently, temperature control of the fixing apparatus is degraded. As a result, in a configuration in which contact between a fixing belt as a fixing member and a resistance heating element as a heat generating member is maintained after a given image formation, the temperature of the resistance heating element fluctuates with an interval between the preceding image formation and the next image formation. As a result, even if the temperature of the fixing member is detected and a prescribed voltage is applied to the resistance heating element to control temperature, the temperature of the resistance heating element does not achieve the target temperature. Accordingly, the temperature of the fixing belt cannot ultimately be controlled as intended.

BRIEF SUMMARY OF THE INVENTION

Accordingly, the present invention provides a novel fixing device that comprises an endless flexible fixing member to heat and fuse a toner image by rotating in a prescribed direction, a pressing roller, and a contact member secured on an inner circumferential surface side of the fixing member to contact the pressing roller via the fixing member forming a nip on a front surface of the fixing member. A support member is provided to back up the contact member against pressure of the pressing member to minimize deformation of the contact member. A heating element is provided and is extended along the fixing member other than the nip on an inner circumferential surface side of the fixing member to generate heat. The fixing member contacts the heating element via a gap of a prescribed size or directly contacts the heating element by a prescribed pressure when it is rotating, and continuously separates from the at least one heating element by a prescribed distance greater than the size of the gap when it stops rotating.

In another aspect of the present invention, the fixing member rotates in an opposite direction when it stops rotating to that when it is rotating.

In yet another aspect of the present invention, temperature of the fixing member starts being increased when the fixing member starts rotating while contacting the heating element via a prescribed gap or directly contacting the heating element by a prescribed pressure.

In yet another aspect of the present invention, the heating element includes first and second heating parts neighboring to each other in a running direction of the fixing member. The second heating part is disposed upstream of the nip. A temperature detector is provided and is disposed opposite a position between the first and second heating parts to detect temperature of the fixing member. The fixing member continuously separates from the first heating part by a prescribed distance greater than the size of the gap when it stops rotating.

In yet another aspect of the present invention, a calorific value of each of the first and second heating elements is controlled separately based on a detection result of the temperature detector.

In yet another aspect of the present invention, the fixing member includes a cooling mechanism to cool the heating element when the fixing member stops rotating.

In yet another aspect of the present invention, a holder is provided to support the heating element when the fixing member stops rotating.

In yet another aspect of the present invention, an image forming apparatus comprises a toner image forming device to form a toner image and a fixing device to fix the toner image onto a recording medium. The fixing device includes an endless flexible fixing member to heat and fuse a toner image by rotating in a prescribed direction, a pressing roller, and a contact member firmly disposed on an inner circumferential surface side of the fixing member to contact the pressing roller via the fixing member while forming a nip on a front surface of the fixing member. A support member is provided to back up the contact member against pressure of the pressing member to minimize deformation of the contact member. A heating element is extended along the fixing member other than the nip on an inner circumferential surface side of the fixing member to generate heat. The fixing member contacts the heating element via a gap having a prescribed size or directly contacts the heating element by a prescribed pressure when it is rotating, and continuously separates from the heating element by a prescribed distance greater than the size of the gap when it stops rotating.

BRIEF DESCRIPTION OF THE DRAWINGS

A more complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
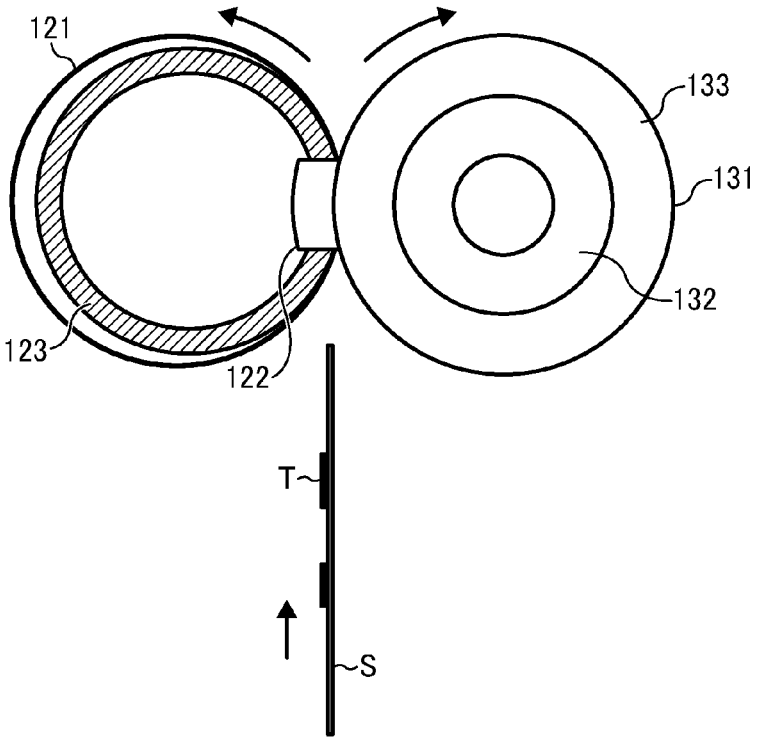
FIG. 1 is a schematic diagram illustrating a configuration of a fixing device according to one embodiment of the present invention.

Referring now to the drawings, wherein like reference numerals designate identical or corresponding parts throughout the several views thereof and in particular to FIG. 1, a fixing device is described.

As shown, the fixing device mainly consists of a fixing belt 121 serving as a fixing member, a contacting member 122, a resistance heating element 123, and a pressing roller 131 serving as a pressing member. The fixing belt 121 is a thin-flexible endless belt and travels and circulates in a direction shown by arrow in FIG. 1, i.e., counter-clockwise. In an interior of the fixing belt 121 (e.g. on the inner circumferential surface side), the contacting member 122 and the resistance heating unit 123 or the like are secured. The fixing belt 121 is pressed by the contacting member 122 and forms a nip between itself and the pressing roller 131.

Each end of the contacting member 122 in its widthwise direction is securely supported by each side plate, not illustrated, disposed in the fixing device. The contacting member 122 is not conductive, i.e., insulator, and thus can be made of plastic, ceramic, and glass or the like. Thus, the contacting member 122 is not heated even when a voltage is applied to the resistance heating element 123.

A gap (δ; delta) is formed between an inner circumferential surface of the fixing belt 121 and the resistance heating element 123 at a position distanced from the nip, and is greater than about 1 mm and less than about 0 mm (e.g. 0 mm$\delta<\delta\leq 1$ mm).

However, since even if each end of the contacting member 122 in its widthwise direction is securely supported by each of the side plates of the fixing device, the contacting member 122 sometimes deforms and pressure at the nip accordingly changes. Then, a supporting member 25 is sometimes provided to prevent the deformation of such a contacting member 122. Therefore, a fixing device of FIG. 2 additionally includes such a supporting member 125 beside the members of the fixing device of FIG. 1.

The supporting member 125 is made of metal, such as stainless steel, iron, etc., having high mechanical strength, and can prevent the contacting member 122 from bending even receiving pressure from the pressing roller 131. Specifically, unless otherwise, a widthwise center of the contacting member 122 largely bends due to the pressure applied to both ends in its widthwise direction.

Figure 2:
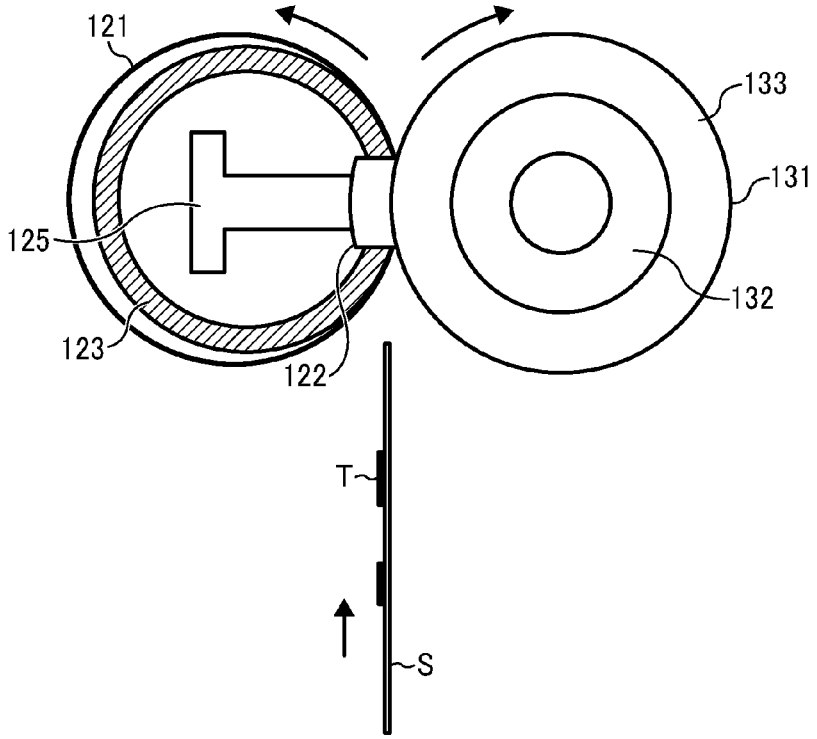
FIG. 2 is a schematic diagram illustrating a partial modification of the fixing system shown in FIG. 1.

Also in this fixing system of FIG. 2, the resistance heating element 123 actively (directly) heats the fixing belt 121, while the contacting member 122 does not actively heat the fixing belt 121. Consequently, the fixing belt 121 is heated by the resistance heating element 123 until it reaches the nip.

Now, exemplary behavior of the fixing system is described. When the image forming apparatus receives an output signal, a driving device (not shown) starts its operation and a resistance heating element 123 starts heating in synchronism therewith. The resistance heating element 123 and the driving device do not necessarily start at the same time, and may separately and independently start their operations by preferably designating a start time independently.

Power of the driving device is transmitted to the pressing member by a power transmission (not shown) and the pressing roller 131 accordingly starts rotating. A rotational force of the pressing roller 31 is transmitted to the fixing belt 121 in contact therewith and starts being driven.

Now, a gap between the fixing belt 121 and the resistance heating element 123 is described with reference to FIG. 1. The fixing belt 121 is entirely guided by the resistance heating element 123 other than the nip via a gap having a prescribed size less than about 1 mm therebetween. Since a tension is not caused in the fixing belt 121, a track of the fixing belt 121 changes when the fixing belt stops rotating from when it rotates.

Figure 3A:
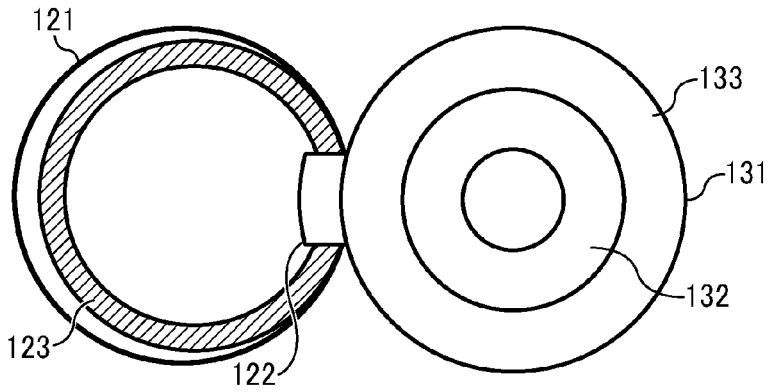
FIGS. 3A and 3B are schematic diagrams illustrating behavior of a fixing belt used in the fixing system of FIG. 1.
Figure 3B:
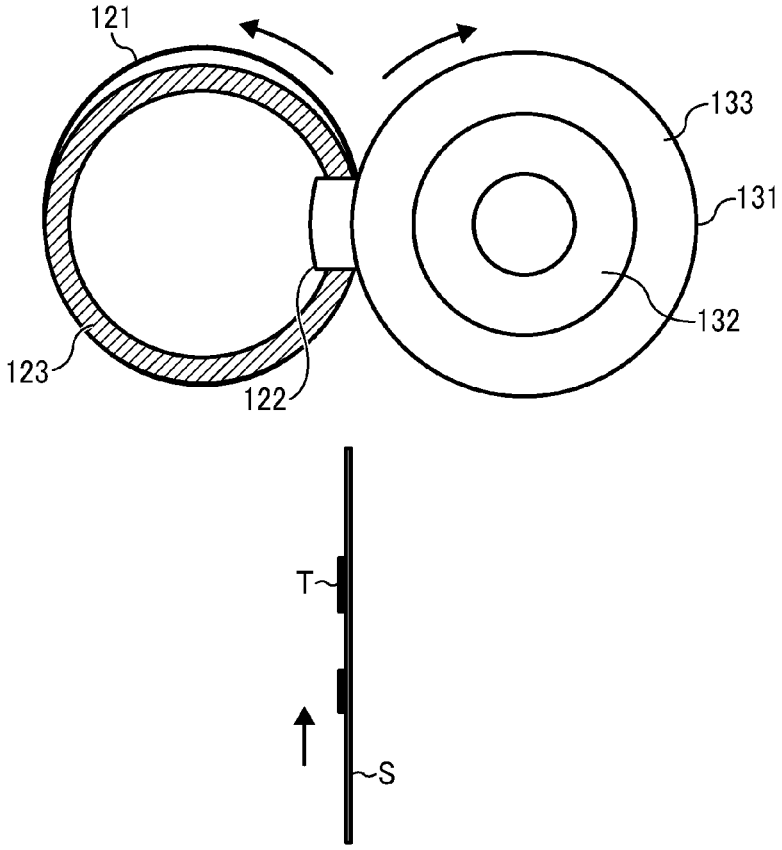

During the rotation, i.e., the circulation of the belt as shown in FIG. 3B, since a driving force (i.e., a pulling force) is caused from a nip entrance toward its exit, an inner circumferential surface of the fixing belt 121 contacts the resistance heating element 123 at the nip entrance side (i.e., an approach side). Whereas, the fixing belt 121 shows behavior to separate from the resistance heating element 123 at the nip exit side maintaining the gap of less than 1 mm therefrom, because the nip capable of minimizing bulge caused by a centrifugal force is missing there.

By contrast, when it is left not being rotated nor circulated as shown in FIG. 3A, since the driving force is not applied to the fixing belt 121 in this state, and accordingly the pulling force coming from the entrance side of the nip does not work at the nip, the inlet and outlet sides of the fixing belt 121 have a symmetrical shape about the nip.

However, the inlet and outlet sides do not have the symmetrical shape immediately after when the fixing belt 121 stops rotation as shown in FIG. 3A, and a given time period is needed to obtained the symmetrical shape of FIG. 3A after start its rotation (see, FIG. 3B). Here, the given time period varies depending on unit type. This tendency especially becomes noticeable when lubricant is employed between the fixing belts 121 and the resistance heating element 123, and accordingly, it sometimes takes from a few to several dozens of minutes until the condition shown in FIG. 3A is obtained.

When no gap exists between the fixing belt 121 and the resistance heating element 123 as at the nip entrance side as shown in FIG. 3B, the resistance heating element 123 can directly effectively heat the heat fixing belt 121 without waste of energy. The, to obtain no gap condition like that, the fixing belt 121 is adjusted to contact the resistance heating element 123 via a predetermined size of a gap or to directly contact therewith a prescribed pressure when circulated. Whereas when the circulation is stopped, the fixing belt 121 is continuously separated from the resistance heating element 123 via a larger gap having more than the predetermined size.

Conversely, when the gap is formed between the fixing belt 121 and the resistance heating element 123 like at the nip exit side as shown in FIG. 3B, the resistance heating element 123 cannot effectively heat the fixing belt 121 there without waste of energy. Otherwise, the resistance heating element 123 excessively increases its own temperature (i.e., overheat), and possibly does not function as a heater depending on an increased temperature. This tendency is noticeable, because this system particularly quickly increases temperature.

Figure 4:
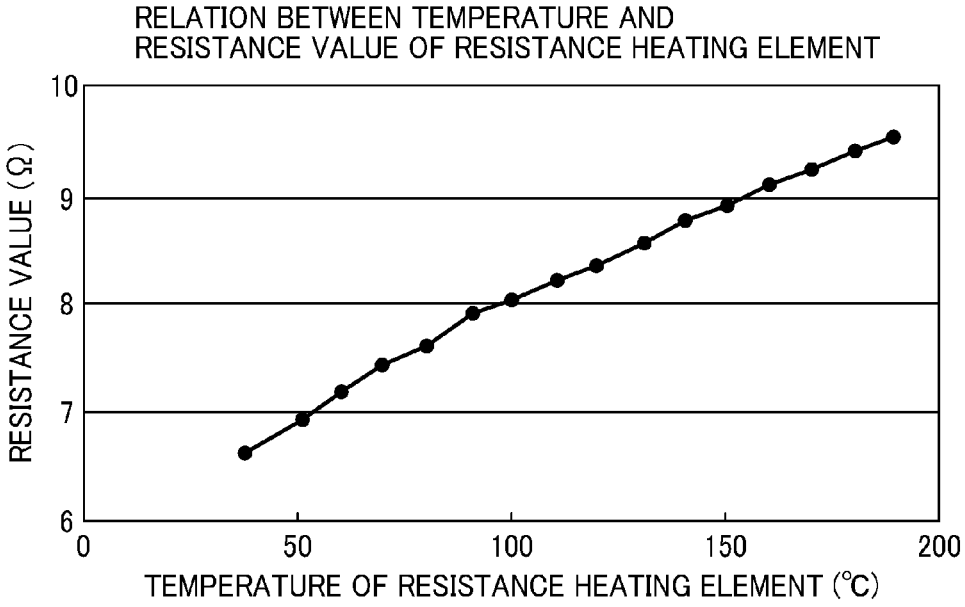
FIG. 4 is a diagram illustrating a change in temperature of a fixing belt used as the fixing member of FIG. 3 and that of a resistance heating element.

In any case, when temperature of the fixing belt 121 reaches a given level, a recording sheet S serving as a fixing object is transported and receives heat and pressure when passing through the nip of the fixing device. Consequently, an unfixed image is fused onto the recording sheet S. A relationship between an internal resistance and a temperature of a resistance heating element is shown in FIG. 4. In general, since when temperature of the resistance heating element is high, the internal resistance (thereof) is great, an amount of current contributing to heating decreases, and accordingly a desired calorific value cannot be obtained even applying the same amount of voltage. By contrast, when a prescribed voltage is applied supposing that temperature of the resistance heating element is high, an amount of current contributing to heating becomes excessive, and accordingly a calorific value is more than a desired level when the temperature of the resistance heating element is in fact low. As a result, an excessive temperature-increased condition is possibly induced as mentioned above with reference to a situation in which the gap is formed between the fixing belt 121 and the resistance heating element 123. This tendency especially becomes noticeable due to its quick temperature increasing system. A temperature detection device can be provided just to the resistance heating element, a cost increases.

Further, since it is undesirable, as mentioned above, that a gap is formed between the fixing belt 121 and the resistance heating element 123, the temperature detection device cannot be provided in reality between the fixing belt 121 and the resistance heating element 123. Whereas, when the temperature detection device is disposed in an interior side of the resistance heating element 123 (i.e., on the side of its rotation center), such an arrangement interferes with downsizing of the fixing device, and sometimes necessitates a particular layout of wire-harness for the temperature detection device and/or heat-resistant processing or the like.

Now, several unique features of the present invention are described. First, a point of a first feature of this invention is to control a contact condition of the fixing belt 121 regarding the resistance heating element during its rotation (i.e., circulation) and stop of rotation in the above-described system.

Specifically, in this embodiment, when the fixing belt 121 rotates, a gap is not formed between the fixing belt 121 and the resistance heating element 123 as shown in FIG. 3B. Whereas when the fixing belt 121 stops rotating, the fixing belt 121 and the resistance heating element 123 are separated from each other to form the gap therebetween as shown in FIG. 3A.

Now, a second feature of the present invention is described with reference to FIGS. 3A and 3B. To create the above-described contact condition of the fixing belt 121 regarding the resistance heating element 123 during its rotation and stop of rotation, a prescribed drive transmission device (not shown) is utilized as described below.

Specifically, such a drive transmission device includes a motor and a gear train for transmitting a driving force of the motor to a driving member driving the fixing belt 121. As a second feature of the present invention, the motor has a function to rotate in the opposite direction when the fixing belt 121 stops rotating to that when an ordinary fixing operation is executed. Otherwise, the gear train returns by a prescribed amount of angle when the fixing belt 121 stops rotating. Specifically, according to the second feature of the present invention, when the transmission device reversely rotates, a prescribed force is generated at the nip to move the fixing belt 121 toward the nip entrance side. Consequently, the fixing belt 121 is displaced from a position shown in FIG. 3B to that shown in FIG. 3A even immediately after its stop of rotation.

Figure 5:
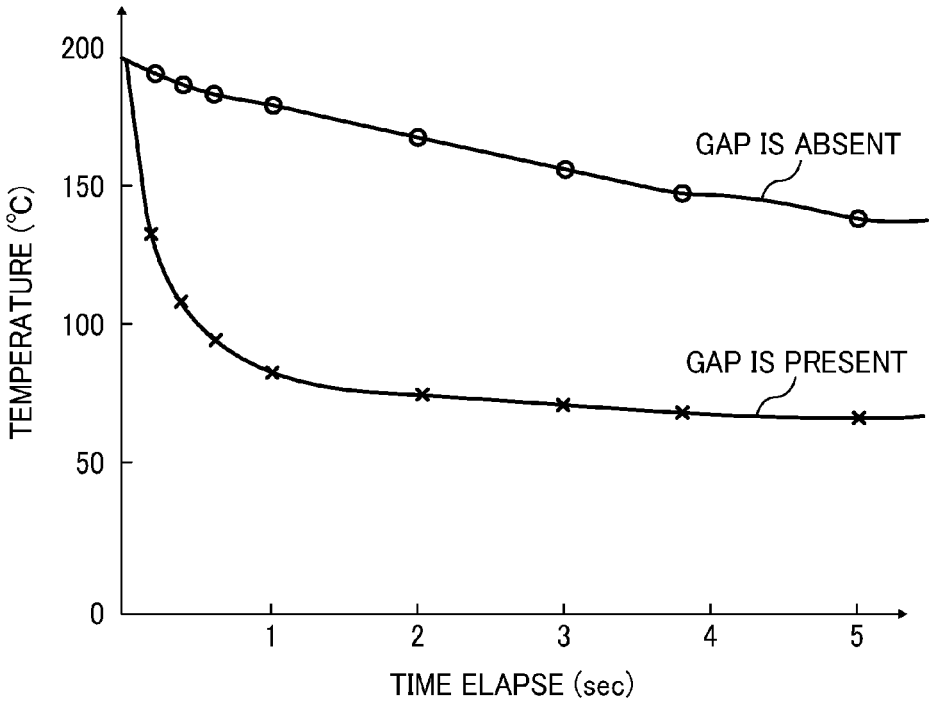
FIG. 5 is a diagram illustrating a change in temperature of the fixing belt when a gap between the fixing belt used as the fixing member and that of the resistance heating element is either present or absent according to one embodiment of the present invention.

Hence, a gap of less than about 1 mm appears between the fixing belt 121 and the resistance heating element 123, so that temperature of the resistance heating element 123 can be quickly decreased more than when it yet contacts the fixing belt 121 as shown in FIG. 5. As a result, variation in calorific value caused by temperature dependence of the resistance heating element 123 can be minimized and heating control of obtaining a target temperature of the fixing belt can be achieved regardless of an interval from when image formation is stopped to when the next image formation starts.

Figure 6:
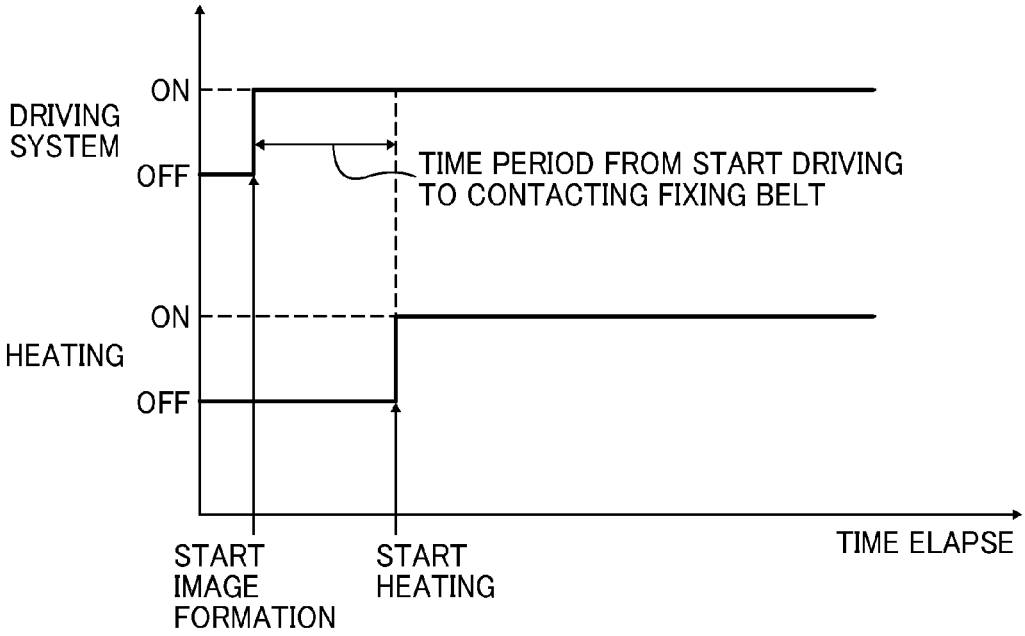
FIG. 6 is a timing chart illustrating a time when the resistance heating element contacts the fixing belt used as the fixing member and a time when the resistance heating element starts its operation according to one embodiment of the present invention.

Now, a third feature of the present invention is described with reference to FIG. 6. The third feature is to designate a time when the resistance heating element 123 starts heating. Specifically, as described above, when a gap exists between the fixing belt 121 and the resistance heating element 123, heat is not effectively conveyed from the resistance heating element 123 to the fixing belt 121, thus wasting energy, and the resistance heating element 123 may undergo an excessive increase in its own temperature. For this reason, the fixing device is controlled in such a manner that when an operation starts, the drive transmission device (not shown) starts its operation as shown in FIG. 6, and power supplying to the resistance heating element 123 is started under a condition in which the fixing belt 121 and the resistance heating element 123 contact each other as shown in FIG. 3B. Hence, this can help to prevent the resistance heating element 123 from overheating.

Figure 7:
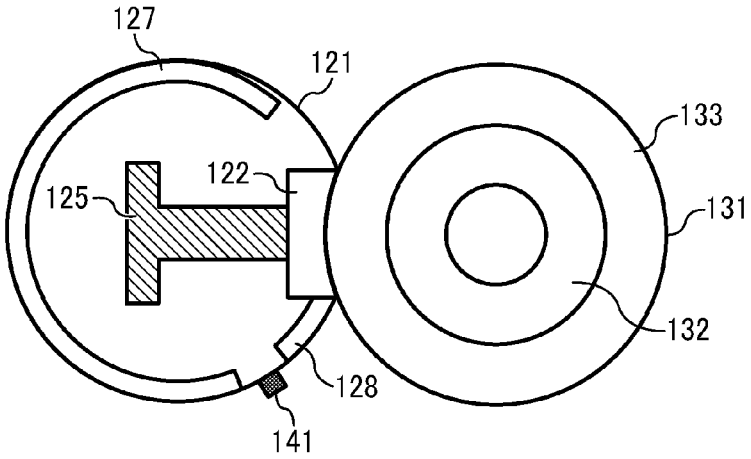
FIG. 7 is a schematic diagram illustrating a modification of the resistance heating element provided in the fixing system according to another embodiment of the present invention.

Now, a fourth feature of the present invention is described with reference to FIG. 7. A point of the fourth feature is to execute temperature control for the fixing belt 121 more accurately. Specifically, as shown in FIG. 7, a resistance heating element 123 opposed to a fixing belt 121 has a multiple structure of first and second resistance heating elements 127 and 128 to appropriately heat the fixing belt 121 different from a monolithic structure of the above-described system.

Calorific values of the first and second resistance heating elements 127 and 128 are individually controlled by a control device, not shown. Therefore, by controlling calorific values of the first and second resistance heating elements 127 and 128 based on temperature detection element 141 having a thermistor, the fixing belt 121 can more effectively be controlled to have a desired temperature. Specifically, the temperature detection element 141 is provided to detect temperature of the fixing belt 121 after heating thereof with the first resistance heating element 127. Whereas, the second resistance heating element 128 disposed downstream of the temperature detection device 141 is provided to correct temperature of the fixing belt 121 more accurately.

Since the second resistance heating element 128 is disposed close to the contacting member 122, a distance between the fixing belt 121 and the second resistance heating element 128 becomes smaller than that between the fixing belt 121 and the first resistance heating element 127, so that partial contact occurs therebetween even if it is designed to be separatable from the fixing belt 121 as described with reference to the first feature of the invention. However, since temperature of the second resistance heating element 128 corresponds to temperature of the fixing belt 121 detected by the temperature detection element 141, it is only necessary that at least the first resistance heating element 127 separates from the fixing belt 121 when the fixing belt 121 stops rotating.

Figure 8:
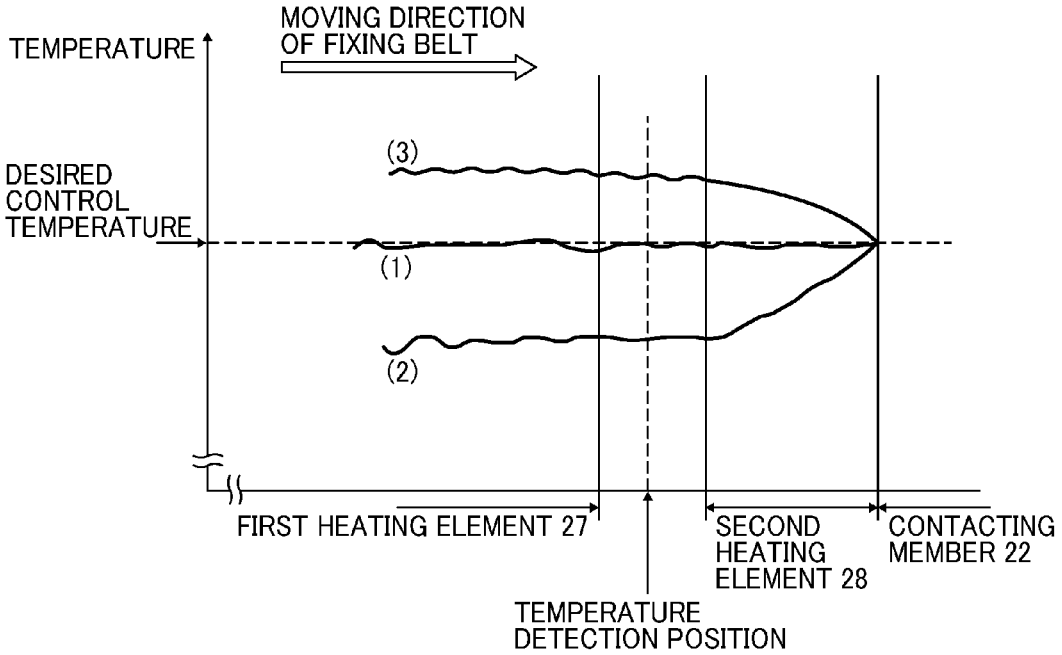
FIG. 8 is a diagram illustrating a change in temperature of the fixing belt with the resistance heating element shown in FIG. 7.

Now, a fifth feature of the present invention is described with reference to FIG. 8. A point of the fifth feature of this invention to control temperature of each of the multiple resistance heating elements of FIG. 7. FIG. 8 schematically illustrates a surface temperature of the fixing belt 121 detected at a temperature detection position and that of the fixing belt 121 when it enters the position of the contacting member 122 after passing through the second resistance heating element 128.

When temperature of the fixing belt 121 passing through the temperature detection device 141 is a desired level, the second resistance heating element 128 is controlled to generate a medium level of a calorific value and keep the temperature of the fixing belt 121 (see, profile shown by a reference numeral 1). Whereas when temperature of the fixing belt 121 passing through the temperature detection device 141 is lower than the desired level, the second resistance heating element 128 is controlled to generate a high level of a calorific value to positively heat the fixing belt 121 so that a surface temperature thereof can reach the desired level of a control temperature (see, profile shown by a reference numeral 2). Further, when temperature of the fixing belt 121 passing through the temperature detection device 141 is higher than the desired level, the second resistance heating element 128 is controlled to generate a low level of a calorific value or to be turned off so that the fixing belt 121 radiates heat to have a surface temperature of the desired level (see, profile shown by a reference numeral 3).

Hence, by adjusting a calorific value to be generated by the second resistance heating element 128 disposed downstream of the fixing belt 121 based on a temperature detected by the temperature detecting device 141 when the fixing belt 121 passes therethrough, temperature of the fixing belt 121 is further accurately controlled to have a desired level.

Figure 9:
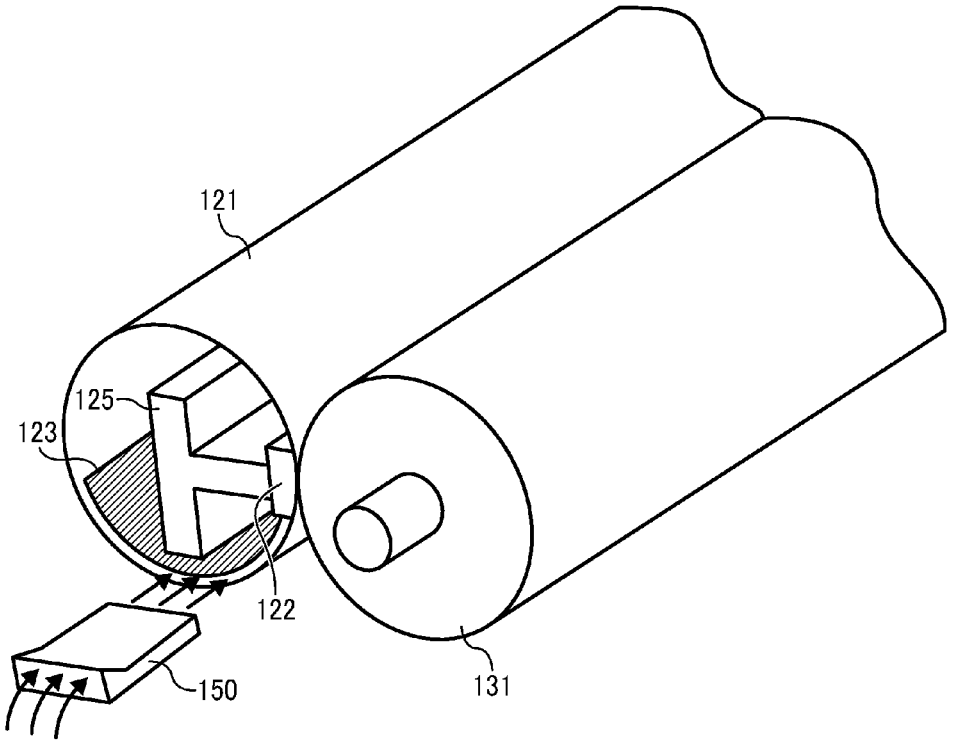
FIG. 9 is a schematic diagram illustrating a cooling mechanism provided in the fixing device according to yet another modification of this invention.

Now, a sixth feature of the present invention is described with reference to FIG. 9. A point of the sixth feature of this invention is to cool the resistance heating element down when the fixing belt 121 stops rotating. Specifically, FIG. 9 is one example of a configuration with a cooling mechanism that cools down the fixing system of FIG. 2. Specifically, a blower system is provided to take in fresh air to the fixing device from an outside thereof at a section between the resistance heating element 123 and a support member 125. More specifically, a fan, not shown, is provided to blow fresh air to a duct 150, one end of which is directed toward the section between the resistance heating element 123 and the support member 125, and cools the resistance heating element 123 down during stop of rotation of the fixing belt 121. Further, a fan already provided in the image forming apparatus to blow air toward sections other than the fixing device, etc., can be utilized as the above-described blower system, not shown.

Figure 10:
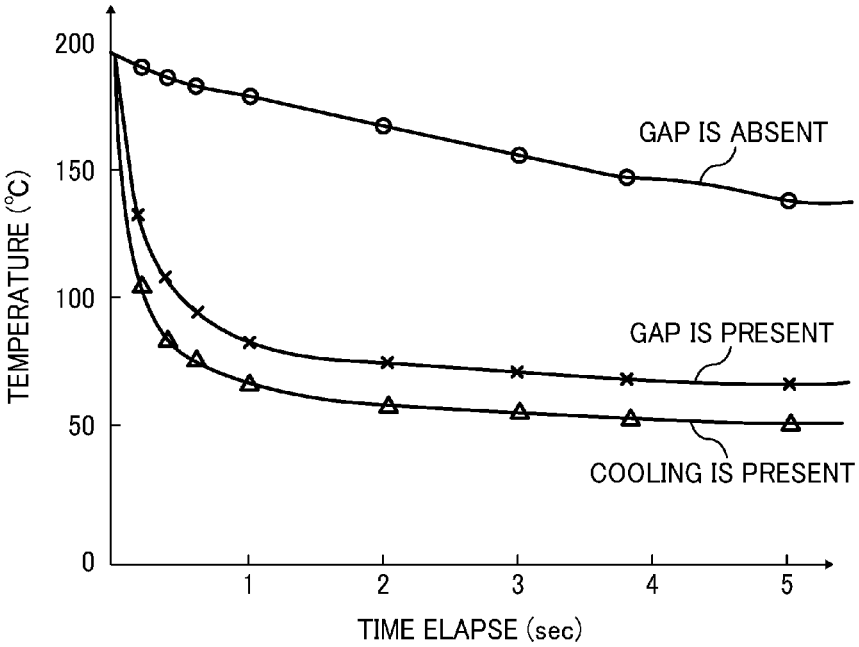
FIG. 10 is a diagram illustrating a change in temperature of the fixing member using the cooling mechanism of FIG. 9.

By blowing fresh air when the fixing belt 121 stops rotating in the above-described system, the resistance heating element can further effectively be cooled down as shown in FIG. 10. In such a situation, the fan is not necessarily blow air all time when the fixing belt 121 stops rotating. Specifically, blowing can be stopped when temperature of the resistance heating element 123 declines to a given level. Further, the blower can start operation before the fixing belt 121 stops rotation without waiting thereof as far as it does not affect a fixing operation for an image.

Figure 11:
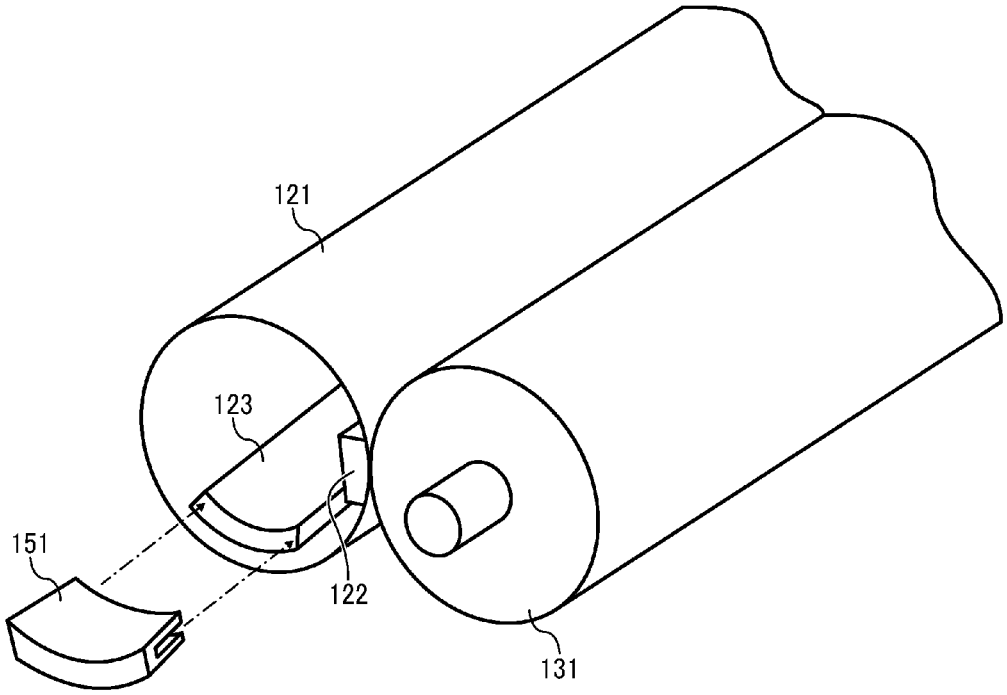
FIG. 11 is a schematic diagram illustrating a partial modification of the fixing device according to one embodiment of this invention.

Now, a seventh feature of the present invention is described with reference to FIG. 11. A point of the seventh feature is to prevent the resistance heating element from deformation or the like. Specifically, the fixing belt 121 separates from the resistance heating element 123 by reversal movement of the fixing device as described earlier. However, since the resistance heating element is mainly composed of a thin film, it sometimes deforms along the fixing belt 121, and accordingly the resistance heating element 123 and the fixing belt 121 cannot effectively separate from each other.

In such a situation, a prescribed member (e.g. a securing member 151 in FIG. 11) is provided on a side plate (not illustrated) or the like to hold an end of the resistance heating element 123 so that the resistance heating element 123 does not displace even when the fixing belt 121 rotates reversely. Hence, the resistance heating element 123 can effectively separate from the fixing belt 121. In addition, deformation of the resistance heating element or similar changes caused by a stress generated therein as a result of separation activity can be reduced at the same time.

Figure 12:
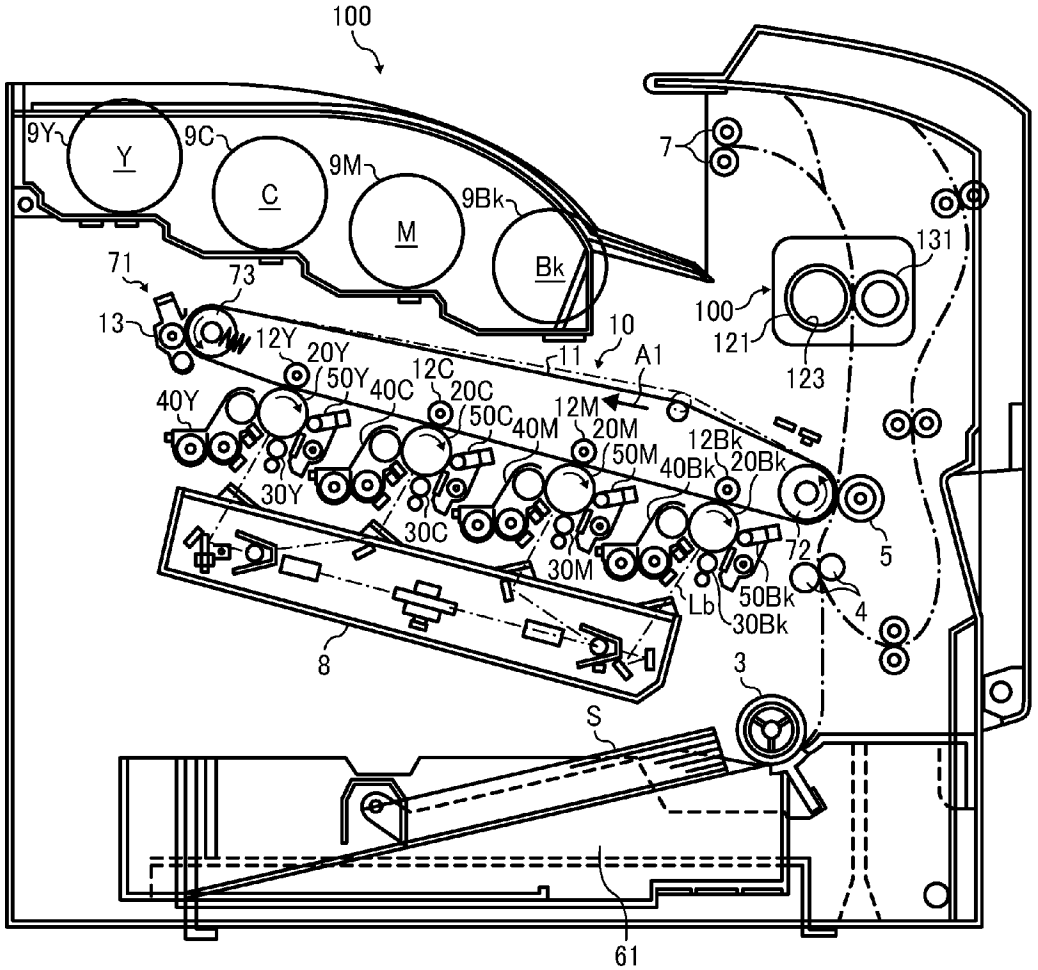
FIG. 12 is a schematic diagram illustrating an image forming apparatus with the fixing device according to one embodiment of the present invention.

Now, a configuration of an image forming apparatus equipped with the above-described fixing system is briefly described with reference to FIG. 12. As shown, an image forming apparatus of FIG. 12 is a color printer employing a tandem system in which multiple color image forming sections are juxtaposed along a belt in a belt expanding direction. However, the present invention is not limited to such a system. Further, instead of the printer, a copier and a facsimile device can adopt the above-described fixing system as well.

More specifically, as shown in FIG. 12, the image forming apparatus 100 accommodates multiple photoconductor drums 20Y, 20C, 20M, and 20Bk as image bearers in a tandem state, i.e., in parallel to each other, which are capable of forming images of resolution colors of yellow, cyan, magenta, and black, respectively.

In such an image forming apparatus 1000 of FIG. 12, visible images formed on the photoconductor drums 20Y, 20C, 20M, and 20Bk are transferred and superposed on an intermediate transfer member of an endless belt (hereafter referred to as a transfer belt), which is movable in a direction shown by arrow A1 confronting the photoconductor drums 20Y, 20C, 20M, and 20Bk, during a primary transfer process. After that, a secondary transfer process is applied to a recording sheet S, and the above-described visible images are transferred thereonto at once.

Further, various devices each executing an image forming process as the photoconductor drum rotates are disposed around each of the photoconductor drums 20Y, 20C, 20M, and 20Bk. To typically describe as to the photoreceptor drum 20Bk executing black image formation, a charge device 30Bk, a developing device 40Bk, a primary transfer roller 12Bk, and a cleaning unit 50Bk are placed in a rotational direction of the photoreceptor drum 20Bk to execute the image formation process. An optical writing device 8 is used to execute writing after a charging process.

The above-described superposing transfer process is executed regarding the transfer belt 11 in the below described manner when the transfer belt 11 moves in the rotational direction A1. Specifically, each of the visible images formed on the photoconductor drum 20Y, 20C, 20M, and 20Bk is transferred onto the transfer belt 11 by delaying a transfer time from a previous one from upstream to downstream in the direction A1 to have these images transferred onto the same position on the transfer belt 11. At the same time, a transfer voltage is timely applied thereto from each of primary transfer rollers 12Y, 12M, 12C, and 12Bk disposed opposite the photoconductor drums 20Y, 20C, 20M, and 20Bk, respectively, across the transfer belt 11.

Each of the photoconductor drums 20Y, 20C, 20M, and 20Bk lines up in this order from upstream in the direction A1 being quipped with an imaging station for forming a corresponding one of images of cyan, magenta, yellow, and black.

Further, the Image formation apparatus 1000 includes four imaging stations executing image formation processing per color, a transfer belt unit 10 having multiple primary transfer rollers 12Y, 12C, 12M, and 12Bk, and a transfer belt 11 disposed above being opposed to each of the photoconductor drums 20Y, 20C, 20M, and 20Bk, a secondary transfer roller 5 disposed opposite the transfer belt 11 and driven by the transfer belt 11 as a transferal member, an intermediate transfer belt cleaning device 13 disposed opposite the transfer belt 11 to clean a surface of the transfer belt 11, and an optical writing device 8 disposed below being opposed to the four imaging stations.

Further, the optical writing device 8 includes a semiconductor laser as a light source, a coupling lens, an f-theta lens, a toroidal lens, a turn mirror, and a polygonal minor as a deflection device or the like. The optical writing device 87 emits an optical writing light Lb onto the photoconductor drums 20Y, 20C, 20Bk, and 20M per color and forms latent electrostatic images thereon. Although reference signs are added only to the black imaging station in FIG. 12 and typically described for the sake of convenience, the other image stations have similar configurations.

Further included in the image forming apparatus 1000 are a sheet feeding device 61 of a sheet cassette that stacks multiple recording sheets S thereon to be transported therefrom to a gap between each of the photoconductors 20Y, 20M, 20C, and 20Bk, and the transfer belt 11, a pair of registration rollers 4 that launches the recording sheet S conveyed from the sheet feeding device 61 toward a transfer section between each of the photoconductors 20Y, 20M, and 20C, 20Bk and the transfer belt 11 at a given time to synchronize with formation of toner images in the image stations, and a sensor, not shown, to detect an effect that a tip of the recording sheet S reaches the registration roller 4.

Yet further included in the image forming apparatus 1000 are a roller-type fixing device 100 configured in a unit to fix a transferred toner image onto a recording sheet S, a sheet exit roller 7 to drain the recording sheet S with a fixed toner image thereon to an outside of a body of the image forming apparatus 1000, a sheet exit tray 17 disposed on the body of the image forming apparatus 1000 to stack the recording sheets S thereon ejected outside of the body of the image forming apparatus 1000 by the sheet exit tray 17, and multiple toner bottles located at a lower side of the image forming apparatus 1000 filled with yellow, cyan, magenta, and black color toner particles 9Y, 9C, 9M, and 9Bk, respectively, and the other similar devices.

Further, the transfer belt unit 10 has a driven roller 73 and a driving roller 72 collectively stretching the transfer belt 11 therearound beside the primary transfer rollers 12Y, 12C, 12M, and 12Bk and the transfer belt 11. The driven roller 73 has a function to induce the transfer belt 11 to generate a tension therein, and is accordingly equipped with a biasing device, such as a spring, etc. Thus, the transfer belt unit 10, and the primary transfer rollers 12Y, 12C, 12M, and 12Bk, the secondary transfer roller 5, and the cleaning device 13 collectively constitute the transfer unit 71.

Further, the sheet feeding unit 61 is disposed at a lower side of the body of the image forming apparatus 1000, and includes a sheet feeding roller 3 that contacts an upper surface of the top most recording sheet S to feed the same toward the pair of registration rollers when driven and rotated counterclockwise.

As shown in FIG. 1, the fixing device 100 is configured by the fixing belt 121, the resistance heating element 123 installed within a loop of the fixing belt 121, the pressing roller 131, and the supporting member 122, not shown. Thus, in accordance with the above-described various features, the fixing device 100 fixes the toner image by applying heat and pressure to the recording sheet S bearing the toner image thereon onto the surface of the recording sheet S.

Further, a cleaning unit 13 is mounted on the transfer device 71 and includes a cleaning blade and a cleaning brush disposed opposite the transfer belt 11 or contacting thereto to scrape off and remove foreign substance, such as residual toner, etc., remaining on the transfer belt 11 with the cleaning brush and/or blade to clean the transfer belt 11.

Further, the cleaning device 13 has an ejection device, not shown, to convey and scrap the residual toner removed from the transfer belt 11. As described earlier, the image forming apparatus 1000 shown in FIG. 1 employs a system in which the color images formed on each of the photoconductor drums are transferred sequentially onto the transfer belt 11 and superimposed one atop another, after which the synthesized color image is transferred onto the recording sheet S at once. However, instead of the above-described system, another system can be employed, in which a recording sheet S is borne on a transfer belt 11 while facing each of the photoconductor drums, and color images are transferred and superimposed directly on the recording sheet S.

According to one embodiment of the present invention, since the fixing member contacts the heating element via a gap of a prescribed size or directly contacts the heating element by a prescribed pressure when it is rotating, separation of the resistance heating element and the fixing belt from each other can substantially be prevented at the outlet side of the nip during its circulation. Further, since the fixing member can be directly heated by the resistance heating element, wasteful power consumption can be minimized. For the same reason, the fixing member can be effectively heated while minimizing excessive temperature rising. Further, since the resistance heating element and the fixing member are arranged close to or contact each other before it completely stops rotating, a time period until the stop of the fixing belt may be minimized, and separation of those can be quickly made after the stop thereof. Further, since a shape of the fixing member is symmetrical at the inlet and outlet sides about the nip, calorific variation caused by temperature dependence of the resistance heating element 123 can be minimized. Accordingly, uneven temperature distribution can be almost prevented over the entire region of the fixing member, and accordingly a prescribed temperature is maintained as a warm-up start temperature of the resistance heating element.

Further, according to one embodiment of the present invention, since the fixing member rotates in an opposite direction when it stops rotating in one direction to that when it is rotating to minimize heat transmission from the resistance heating element, temperature of the fixing member can be controlled to be an intended level without employing a special heat transfer minimizing system but only an existing system.

Further, according to one embodiment of the present invention, the heating element includes first and second heating parts neighboring to each other at positions of upstream and downstream of the nip in a running direction of the fixing member, and a calorific value of each of the first and second heating parts is controlled separately. Accordingly, even if the fixing member and the heating element enter a condition in which heat transmission therebetween is minimized, specifically, they do not make a light contact nor are separated from each other, temperature of the fixing member can be controlled to have a prescribed level as a warming up start temperature by separately controlling temperature of the fixing members.

Further, according to one embodiment of the present invention, a cooling mechanism is provided to cool the heating element when the fixing member stops rotating. Accordingly, by minimizing heat transmission from the heating element to the fixing member, temperature of the fixing member can be maintained at a prescribed level as a warming up start temperature.

Numerous additional modifications and variations of the present invention are possible in light of the above teachings. It is therefore to be understood that within the scope of the appended claims, the present invention may be practiced otherwise than as specifically described herein.

What is claimed is:

1. A fixing device comprising:

a rotatable, endless, flexible fixing member to heat and fuse a toner image by rotating in a first direction;

a drive transmission device configured to generate a first driving force to rotate the flexible fixing member in a first direction and to generate a second driving force to rotate the flexible fixing member a second direction opposite the first direction;

a pressing roller disposed opposite the fixing member;

a contact member firmly disposed on an inner circumferential surface side of the fixing member to contact and press the fixing member against the pressing roller to form a nip on the outer circumferential surface of the fixing member;

a support member to reinforce the contact member against the pressing member to reduce deformation of the contact member; and a heating device extending along the fixing member at a location other than the nip on an inner circumferential surface side of the fixing member to generate heat, wherein the drive transmission device is configured to apply the first driving force to the fixing member such that a downstream portion of the fixing member from the nip separates from the heating device via a gap of a prescribed size while an upstream portion of the fixing member from the nip contacts the heating device with a prescribed pressure during rotation of the fixing member in the first direction, and the drive transmission device is configured to apply the second driving force to the fixing member after the fixing member stops rotating in the first direction such that said upstream portion of the fixing member separates from the heating device by a prescribed distance.

2. The fixing device as claimed in claim 1, wherein temperature of the fixing member is controlled to start increasing when the fixing member starts rotating in the first direction while contacting the heating device via the upstream portion with the prescribed pressure at a set amount of time after the first driving force is applied thereto.

3. The fixing device as claimed in claim 1, wherein the heating device comprises a first heating element and a second heating element, the second heating element being disposed upstream of the nip, the fixing device further comprising a temperature detector disposed between the first and second heating elements to detect a temperature of the fixing member.

4. The fixing device as claimed in claim 1, further comprising:

a securing member to reinforce the heating device when the fixing member rotates in the second direction.

5. The fixing device as claimed in claim 3, wherein a calorific value of each of the first heating element and the second heating element is separately controlled based on a detection result obtained by the temperature detector.

6. The fixing device as claimed in claim 3, further comprising:

a cooling mechanism to cool the at least one of the first and second heating elements when the fixing member stops rotating.

7. The fixing device as claimed in claim 1, wherein said prescribed pressure and prescribed size are adjustable via the fixing belt.

8. A fixing device comprising:

rotatable, endless, flexible fixing means for heating and fusing a toner image by rotating in a first direction;

driving means for generating a first driving force to rotate the flexible fixing means in the first direction and to generate a second driving force to rotate the flexible fixing means a second direction opposite the first direction;

pressing means disposed opposite the fixing means while pressing against the endless fixing means;

means for contacting the pressing means via the fixing means and forming a nip on a front surface of the fixing means, said contacting means firmly disposed on an inner circumferential surface side of the fixing means;

means for reinforcing the contact means against the pressing means and reducing deformation of the contacting means; and means for generating heat, said heat generating means extending along the fixing means at a location other than the nip on an inner circumferential surface side of the fixing means, wherein the driving means is configured to apply the first driving force to the fixing means such that a downstream portion of said fixing means separates from the heating means via a gap of a prescribed size while an upstream portion of said fixing means contacts the heating means with a prescribed pressure when the fixing means are rotating in the first direction, and the driving means is configured to apply the second driving force to the fixing means after the fixing means stops rotating in the first direction such that the upstream portion of said fixing means separates from the heating means by a prescribed distance.

9. An image forming apparatus comprising:

a housing; and a fixing device included in the housing, said fixing device including:

a rotatable, endless, flexible fixing member to heat and fuse a toner image by rotating in a first direction;

a drive transmission device configured to generate a first driving force to rotate the flexible fixing member in the first direction and to generate a second driving force to rotate the flexible fixing member a second direction opposite the first direction;

a pressing roller disposed opposite the fixing member;

a contact member firmly disposed on an inner circumferential surface side of the fixing member to contact and press the fixing member against the pressing roller to form a nip on the outer circumferential surface of the fixing member;

a support member to reinforce the contact member against the pressing member to reduce deformation of the contact member; and a heating device extending along the fixing member at a location other than the nip on an inner circumferential surface side of the fixing member to generate heat, wherein the drive transmission device is configured to apply the first driving force to the fixing member such that a downstream portion of the fixing member from the nip separates from the heating device via a gap of a prescribed size while an upstream portion of the fixing member from the nip contacts the heating device with a prescribed pressure during rotation of the fixing member in the first direction, and the drive transmission device is configured to apply the second driving force to the fixing member after the fixing member stops rotating in the first direction such that said upstream portion of the fixing member separates from the heating device by a prescribed distance.

10. The image forming apparatus as claimed in claim 9, wherein temperature of the fixing member is controlled to start increasing when the fixing member starts rotating in the first direction while contacting the heating device via the upstream portion with the prescribed pressure at a set amount of time after the first driving force is applied thereto.

11. The image forming apparatus as claimed in claim 9, wherein the heating device comprises:

a first heating element and a second heating element, the second heating element being disposed upstream of the nip, the fixing device further comprising a temperature detector disposed between the first and second heating elements to detect a temperature of the fixing member.

12. The image forming apparatus as claimed in claim 9, further comprising:

a securing member to reinforce the heating device when the fixing member rotates in the second direction.

13. The image forming apparatus as claimed in claim 11, wherein a calorific value of each of the first heating element and the second heating element is separately controlled based on a detection result obtained by the temperature detector.

14. The image forming apparatus as claimed in claim 11, further comprising:

a cooling mechanism to cool the at least one of the first and second heating elements when the fixing member stops rotating.

15. The image forming apparatus as claimed in claim 9, wherein said prescribed pressure and prescribed size are adjustable via the fixing belt.

* * * * *